US008916784B2

(12) United States Patent
Chuang

(10) Patent No.: US 8,916,784 B2
(45) Date of Patent: Dec. 23, 2014

(54) PUSH BUTTON SWITCH

(71) Applicant: Yu-Chen Chuang, Taoyuan County (TW)

(72) Inventor: Yu-Chen Chuang, Taoyuan County (TW)

(73) Assignee: Taiwan Alpha Electronic Co., Ltd., Taoyuan (TW)

( * ) Notice: Subject to any disclaimer, the term of this patent is extended or adjusted under 35 U.S.C. 154(b) by 128 days.

(21) Appl. No.: 13/803,679

(22) Filed: Mar. 14, 2013

(65) Prior Publication Data

US 2014/0262718 A1 Sep. 18, 2014

(51) Int. Cl.
*H01H 13/70* (2006.01)
*H01H 13/52* (2006.01)

(52) U.S. Cl.
CPC ..... *H01H 13/52* (2013.01)
USPC ..... 200/5 R

(58) Field of Classification Search
USPC ..... 200/5 R, 9, 16 R, 16 C, 17 R, 50.36, 200/51.16, 314, 341
See application file for complete search history.

(56) References Cited

U.S. PATENT DOCUMENTS 4,268,735 A * 5/1981 Iwakiri ..... 200/314
8,044,313 B2 * 10/2011 Yamamoto ..... 200/314
2011/0108403 A1 * 5/2011 Kukita ..... 200/341

* cited by examiner

*Primary Examiner* — Edwin A. Leon
(74) *Attorney, Agent, or Firm* — Rosenberg, Klein & Lee

(57) ABSTRACT

A push button switch having a base, a plurality of contact plates, a switching assembly, and a push button assembly. The base has a first cavity with a plurality of first, second, and third conductive terminals assembled therein. A length of the first conductive terminal is greater than that of the second and third conductive terminals. The contact plate is of a planar structure or has an extending structure. The switching assembly has a switching body with a displacement-restricting guiding trench and a plurality of second cavities and a plurality of switching units. The switching units are respectively arranged in the second cavities and push against the contact plates. The push button assembly is connected to the base and has a pushing element and a first elastic unit. The pushing element pushes against the displacement-restricting guiding trench and the first elastic unit is assembled to the pushing element.

11 Claims, 7 Drawing Sheets

PUSH BUTTON SWITCH

FIELD OF THE INVENTION

The present invention relates to a push button switch, and more particularly relates to a push button switch with a contact plate of a planar structure or a contact plate with an extending structure protruded therefrom and the conductive states is switched using the contact plate to contact different conductive terminals.

BACKGROUND OF THE INVENTION

In the modern age glutted with electronic devices, various electronic equipments are enormously used in our daily lives and working spaces. Among the various components being used in the electronic equipments, the push button switch is broadly used to control on and off states of the power of the electronic equipments, such as the flash light, the traditional mobile phone, and etc.

The structure of the push button switch includes a push button. When pressing the push button, a spring is compressed and a push bar is moved toward a contact plate so as to have the two metal terminals in the base conducted through the contact plate. Thereby, the current is capable of flowing from one metal terminal, through the contact plate, to another metal terminal. When the pressing force is released from the push button, the recovery force of the spring drives the push bar back to its original position to separate the contact plate and the metal terminals and cut off the conductive current.

In views of the structure of the above mentioned traditional push button switch, to switch the contact plate with respect to the metal terminals to change the contact positions thereof for the purpose of on/off switching, the push button switch needs the components such as the spring, the push bar, and the contact plate to proceed a series of movements. The spring is especially indispensable because the contact plate cannot be switched with merely the pushing bar.

However, according to the structure of the traditional push button switch, it is understood that the such push button switch tends to have a serial of movements along a single vertical direction. Thus, when the user presses the switch, the pressure would be transferred downward to a series of components through the compression of the spring such that the withstanding force of each of the components would be quite large. In addition, since the push button switch must be frequently used, under the above mentioned operating condition with such a large pressure, lifetime of the push button switch might be shortened.

In addition, in the traditional push button switch, the contact plate is designed as a single plane, if the material strength of the contact plate is not good enough, it is obvious that such structure cannot withstand the repeatedly vertical pressing movements of the pushing bar.

Moreover, the traditional push button switch only has one circuit loop, which cannot fulfill the need of multi-function applications.

It is believed that based on the understanding of prior art as mentioned above, people skilled in the art will notice the shortcomings of the traditional push button switch, which are eager to be resolved.

BRIEF SUMMARY OF INVENTION

According to the above mentioned shortcomings of prior art, a major object of the pre sent invention is to provide an improvement of the push button switch so as to extend the lifetime and fulfill the need of multi-function applications.

To resolve the shortcomings of prior art, a push button switch is provided. The push button switch of the present invention comprises a base, a plurality of contact plates, a switching assembly, and a push button assembly. The base has at least a first cavity. A plurality of first conductive terminals, a plurality of second conductive terminals, and a plurality of third conductive terminals are assembled in the first cavity, and a length of the first conductive terminal is greater than that of the second conductive terminal and the third conductive terminal. The contact plate is of a planar structure, which connected to the plurality of first conductive terminals. The switching assembly is movably connected to the base and comprises a switching body and a plurality of switching units.

The switching body comprises a displacement-restricting guiding trench and a plurality of second cavities. The displacement-restricting guiding trench is located on a surface of the switching assembly and the second cavities are oppositely located on another surface of the switching assembly. The switching units are respectively arranged in the second cavities and push against the contact plates. The push button assembly is connected to the base and comprises a pushing element and a first elastic unit. The pushing element pushes against the displacement-restricting guiding trench. The first elastic unit is assembled to the pushing element. Wherein, when the push button assembly is pressed, the pushing element moves in the displacement-restricting guiding trench to sway the switching assembly and the switching unit synchronously. Because the length of the first conductive terminal is greater than that of the second conductive terminal and the third conductive terminal, the contact plates would be tilted thereby to switchably conducted at the second conductive terminals and the third conductive terminals.

As a preferred embodiment of the present invention, each of the plurality of contact plates has at least two connecting grooves for connecting the plurality of first conductive terminals. In addition, each of the plurality of switching unit includes a pushing unit and a second elastic unit, the pushing unit has a groove and pushes against one of the plurality of contact plates, and the second elastic unit is assembled in the groove and partially located in the second cavity. The first elastic unit and the second elastic unit may be selected from a group consisting of a spring and a rubber. Moreover, the push button assembly further comprises a pressing unit, which is connected to the base for a user to press and control the contact plates switchably conducted at one of the plurality of second conductive terminals and the plurality of third conductive terminals.

In addition, another push button switch is provided in accordance with another embodiment of the present invention. A major difference between the push button switch and the above mentioned embodiment is that each of the contact plates of this push button switch has at least an extending structure extended and protruded from the contact plate. Each of the contact plates has an open resulted by the punching process. The bottom of the extending structure is connected to an edge of the open and the extending structure is extended upward and protruded from the planar surface of the contact plate. The extending structure may be composed of metal.

When the push button assembly is pressed by an user, the pushing element moves in the displacement-restricting guiding trench to sway the switching assembly in the first cavity and also the switching unit synchronously to have the switching unit presses the extending structure. Because the extending structure is connected to the edge of the open of the contact plates and the length of the plurality of the first conductive terminals is different from that of the plurality of the second conductive terminals and that of the plurality of the third conductive terminals, the pressing action to the extending structure will tilt the contact plates to have the contact plates switchably conducted at the plurality of second conductive terminals or the plurality of third conductive terminals.

In addition, the push button switch of the present invention has a switching assembly with a plurality of circuit loops for extending the applications of the push button switch. Thus, the shortcomings of prior art can be improved by using the push button switch provided in the present invention.

The embodiments adopted in the present invention would be further discussed by using the flowing paragraph and the figures for a better understanding.

DETAILED DESCRIPTION OF THE INVENTION

There are various embodiments of the push button switch in accordance with the present invention, which are not repeated hereby. The preferred embodiment is mentioned in the following paragraph as an example. It should be understood by those skilled in the art that the preferred embodiments disclosed in the following paragraph are merely an example instead of restricting the scope of the invention itself.

Figure 1:
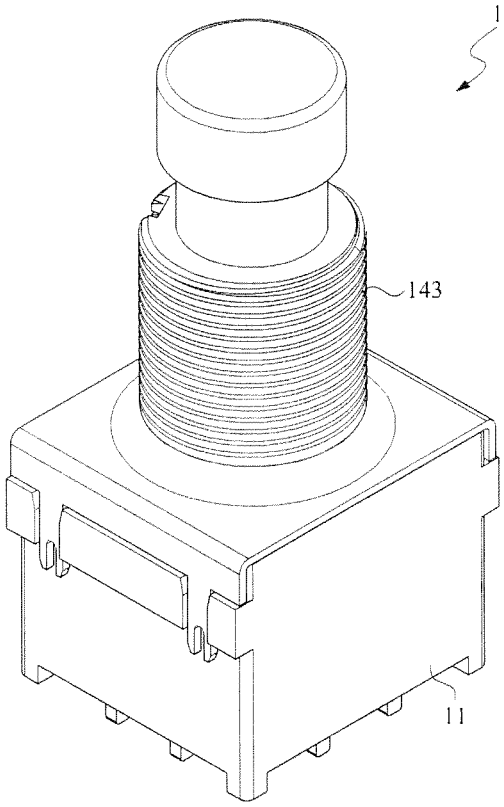
FIG. 1 is a 3D schematic view of a push button switch in accordance with a first preferred embodiment of the present invention.
Figure 2:
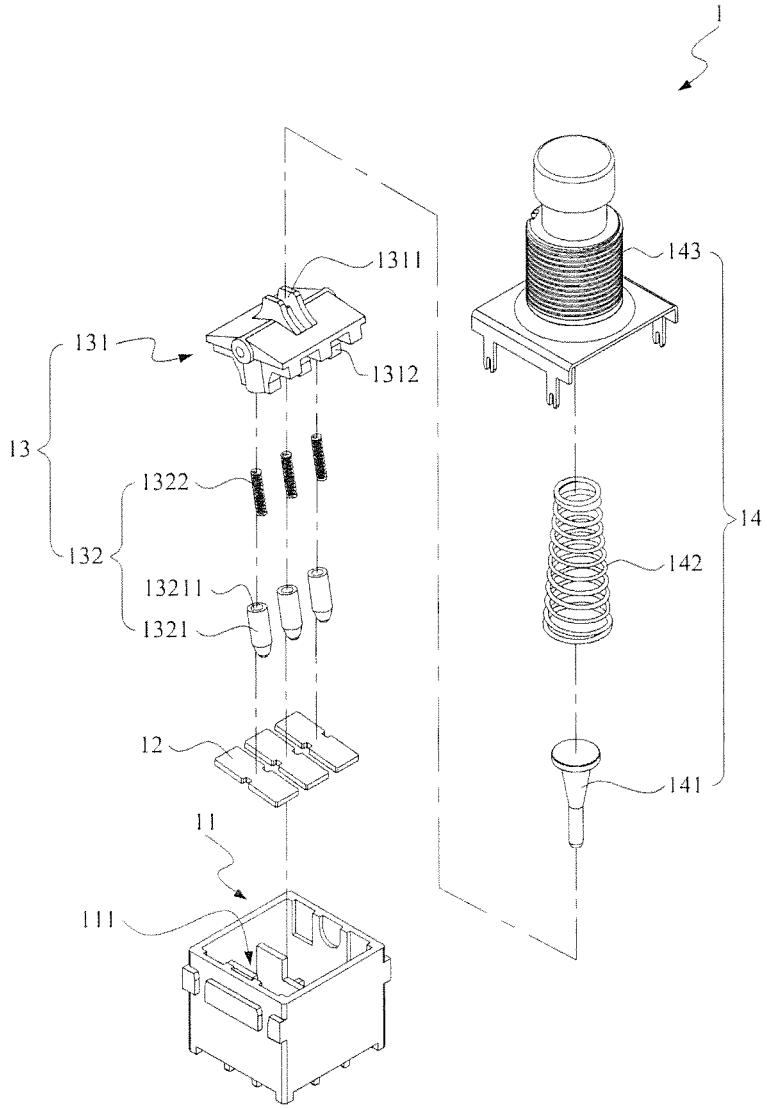
FIG. 2 is a 3D explosive view showing the push button switch in accordance with a first preferred embodiment of the present invention.
Figure 3:
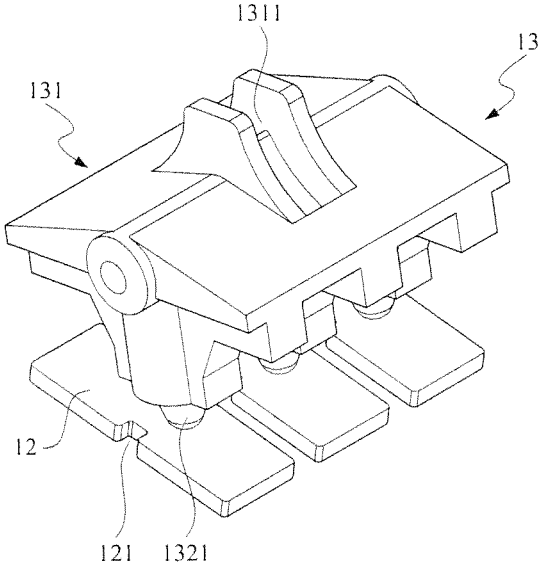
FIG. 3 is a schematic view showing a switching assembly pushing against a contact plate in accordance with the first preferred embodiment of the present invention.
Figure 4:
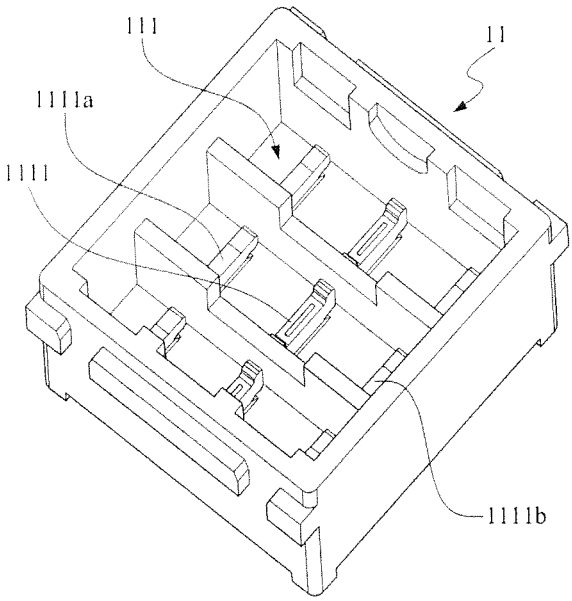
FIG. 4 is a 3D schematic view showing a base in accordance with the first preferred embodiment of the present invention.
Figure 5:
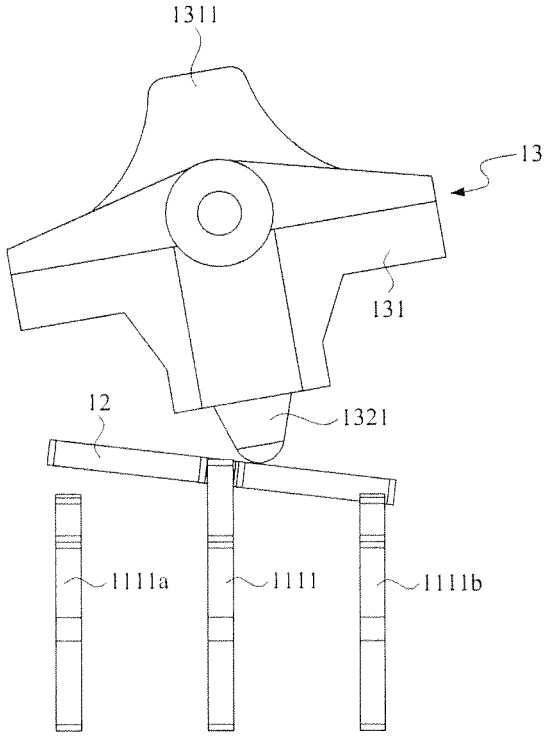
FIG. 5 is a schematic view showing a contact plate switchably conducted at the conductive terminal in accordance with the first preferred embodiment of the present invention.

Please refer to FIG. 1 to FIG. 5, wherein FIG. 1 is a 3D schematic view of a push button switch in accordance with a first preferred embodiment of the present invention, FIG. 2 is a 3D explosive view showing the push button switch in accordance with the first preferred embodiment of the present invention, FIG. 3 is a schematic view showing the switching assembly pushing against a contact plate in accordance with the first preferred embodiment of the present invention, FIG. 4 is a 3D schematic view showing the base in accordance with the first preferred embodiment of the present invention and FIG. 5 is a schematic view showing the contact plate switchably conducted at the conductive terminal in accordance with the first preferred embodiment of the present invention.

As shown, the push button switch 1 includes a base 11, three contact plates 12, a switching assembly 13, and a push button assembly 14. The base 11 has a first cavity 111, and there are three first conductive terminals 1111 (only one of them is labeled), three second conductive terminals 1111*a* (only one of them is labeled), and three third conductive terminals 1111*b* (only one of them is labeled) assembled and penetrated in the first cavity 111. The length of each of the first conductive terminals 1111 is greater than that of each of the second conductive terminals 1111*a* and each of the third conductive terminals 1111*b*.

Each of the contact plate 12 is of a planar structure and is assembled over each of the first conductive terminals 1111. In detailed, each of the contact plate 12 has at least two connecting grooves 121 (only one of them is labeled) for connecting to the first conductive terminals 1111. In the first preferred embodiment of the present invention, the first conductive terminal 1111 is connected to the contact plate 12 by using a protruding portion (not labeled in this figure) thereof to engage the connecting groove 121. However, the present invention is not so restricted, various embodiment capable of connecting the contact plate 12 to the first conductive terminals 1111 should be understood as within the scope of the present invention.

The switching assembly 13 includes a switching body 131 and a plurality of switching units 132 (only one of them is labeled). The switching body 131 has a displacement-restricting guiding trench 1311 and a plurality of second cavities 1312 (only one of them is labeled). The displacement-restricting guiding trench 1311 is located on a surface of the switching assembly 13 and the second cavities 1312 are oppositely located on another surface of the switching assembly 13. Concretely speaking, the displacement-restricting guiding trench 1311 is located on a top surface of the switching assembly 13 and the second cavities 1312 are located on a bottom surface of the switching assembly 13, and the displacement-restricting guiding trench 1311 is a trench with two diagonal surfaces. However the present invention is not so restricted.

In addition, the switching units 132 are respectively arranged in the second cavities 1312. In the first preferred embodiment of the present invention, a plurality of switching units 132 are provided to composes a plurality of circuit loops. Wherein each of the switching units 132 includes a pushing unit 1321 and a second elastic unit 1322. The pushing unit 1321 pushes against one of the plurality of contact plates 12. That is, each pushing unit 1321 pushes against one contact plate 12 to have the switching unit 132 pushes against the contact plate 12.

In addition, the pushing unit 1321 also has a groove 13211. The second elastic unit 1322 is assembled in the groove 13211 and partially located in the second cavities 1312 of the switching body 131. The second elastic unit 1322 may be selected from a group consisting of a spring and a rubber. In the first preferred embodiment of the present invention, the second elastic unit 1322 is a spring. The switching assembly 13 is swayable within the first cavity 111.

The push button assembly 14 includes a pushing element 141, a first elastic unit 142, and a pressing unit 143. The pushing element 141 pushes against the displacement-restricting guiding trench 1311. The first elastic unit 142 may be selected from a group consisting of a spring and a rubber. In the first preferred embodiment of the present invention, the first elastic unit 142 is a spring. The first elastic unit 142 is assembled to the pushing element 141. For example, the first elastic unit 142 may be fitted outside of the pushing element 141. The pressing unit 143 is connected to the base 11.

Wherein, when the push button assembly 143 is pressed by the user, the pushing element 141 moves in the displacement-restricting guiding trench 1311 to sway the switching assembly 13 in the first cavity 111 and also the switching unit 132 synchronously. Because the length of the first conductive terminal 1111 is greater than that of the second conductive terminal 1111*a* and the third conductive terminal 1111*b*, the contact plates 12 would be tilted thereby to switchably conducted at the second conductive terminals 1111*a* or the third conductive terminals 1111*b*.

To give a better understanding of the first preferred embodiment of the present invention, the operation of the push button switch in accordance with the first preferred embodiment is further described in the following paragraphs.

The original state of the push button switch 1 shows that, suffered from the compression force from the first elastic unit 142, the pushing element 141 pushes against the displacement-restricting guiding trench 1311 at a higher point such that the switching assembly 13 tilted along a direction from the upper right to the lower left (the displacement-restricting guiding trench 1311 turned to the right and the pushing unit 1321 turned to the left). In addition, the pushing unit 1321 pushes against the contact plate 12 to have the contact plate 12 inclined to the left to contact the second conductive terminals 1111*a* so as to generate the conductive circuit loops between the plurality of first conductive terminals 1111 and the plurality of second conductive terminals 1111*a*.

Then, as the user presses the pressing unit 143 of the push button switch 1, the first elastic unit 142 is compressed because of the downward movement of the pushing element 141 to compel the lower end of the pushing element 141 moves along the displacement-restricting guiding trench 1311 downward to the left and reaches the tilted surface of the switching body 131. Meanwhile, the switching assembly 13 is swayed to a direction from the upper left to the lower right (the displacement-restricting guiding trench 1311 turned to the left and the pushing unit 1321 turned to the right) as shown in FIG. 5. At this time, the conductive circuit loops are generated between the plurality of first conductive terminals 1111 and the plurality of third conductive terminals 1111*b*. In addition, the circuit loops between the plurality of first conductive terminals 1111 and the plurality of second conductive terminals 1111*a* are opened.

When the user stops pressing the pressing unit 143, the recovery force of the first elastic unit 142 pushes the pressing unit 143 and the pushing element 141 back to the higher point of the displacement-restricting guiding trench 1311. Meanwhile, the conductive circuit loops between the plurality of first conductive terminals 1111 and the plurality of third conductive terminals 1111*b* are remained.

Based on the above mentioned operation of the push button switch with planar contact plates, the conductive state would be changed once the user presses the push button switch. That is, when the conductive state shows that the conductive circuit loops are generated between the plurality of first conductive terminals 1111 and the plurality of second conductive terminals 1111*a*, the pressing action of the user will change the conductive state to have the conductive circuit loops generated between the plurality of first conductive terminals 1111 and the plurality of third conductive terminals 1111*b*, meanwhile the circuit loops between the plurality of first conductive terminals 1111 and the plurality of second conductive terminals 1111*a* are opened. If the user presses the push button switch again, it will be switched back to the conductive state with the conductive circuit loops generated between the plurality of first conductive terminals 1111 and the plurality of second conductive terminals 1111*a*.

Figure 6:
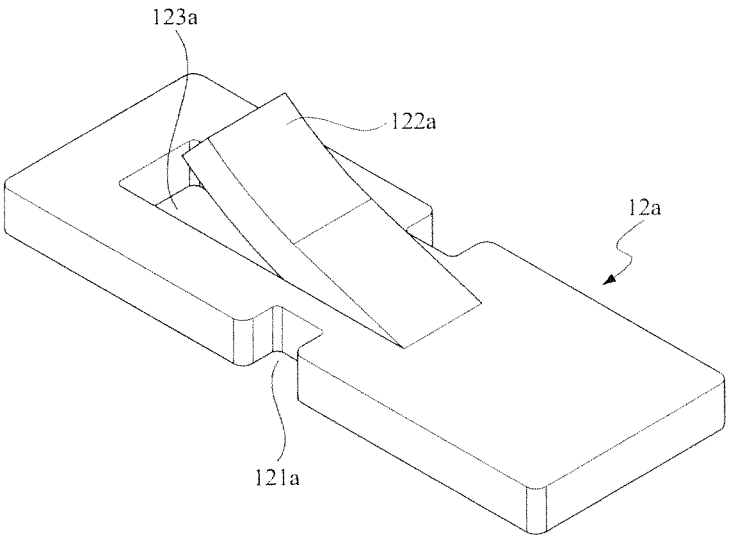
FIG. 6 is a 3D schematic view showing a contact plate in accordance with a second preferred embodiment of the present invention.
Figure 7:
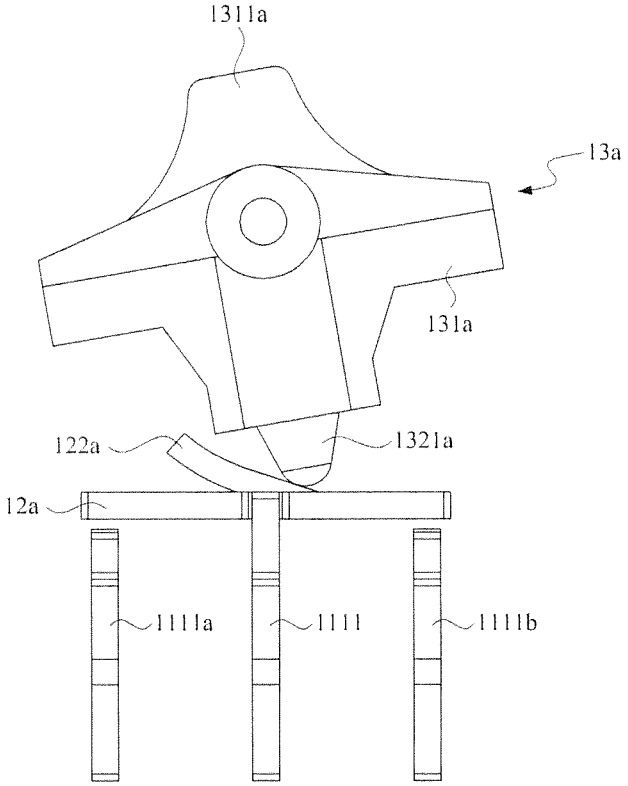
FIG. 7 is a schematic view showing a contact plate switchably conducted at the conductive terminal in accordance with the second preferred embodiment of the present invention.

Please also refer to FIG. 6 and FIG. 7, wherein FIG. 6 is a 3D schematic view showing a contact plate in accordance with a second preferred embodiment of the present invention, and FIG. 7 is a schematic view showing a contact plate switchably conducted at the conductive terminal in accordance with the second preferred embodiment of the present invention. As shown, the difference between the present embodiment and the first preferred embodiment is that, in the present embodiment, each of the contact plates 12*a* has at least an extending structure 122*a*, which may be composed of metal, extended and protruded from the contact plate 12*a*, and each of the contact plates 12*a* also has an open 123*a*, the bottom of the extending structure 122*a* is connected to an edge of the open 123*a*. The open 123*a* may be fabricated together with the extending structure 122*a* by using a punching process. The relationship of the other elements are identical to the first preferred embodiment and thus are not repeated here.

Please refer to FIG. 2 and FIG. 7, when the user presses the pressing unit 143, the pushing element 141 moves in the displacement-restricting guiding trench 1311*a* to sway the switching assembly 13*a* and the switching unit 1321*a* synchronously to have the switching unit 1321*a* pushes against the extending structure 122*a* to tilt the contact plates 12*a* so as to have the contact plates 12*a* switchably conducted at one of the plurality of second conductive terminals 1111*a* and the plurality of third conductive terminals 1111*b*.

To give a better understanding of the first preferred embodiment of the present invention, the operation is described in the following paragraphs in detail. When the push button switch 1 is at the original state, the extending structure 122*a* shows a horizontal position (as shown in FIG. 7) without the pushing from the pushing unit 1321, and the pushing element 141 is located at the original higher point of the displacement-restricting guiding trench 1311*a*. When the user presses the pressing unit 143, the first elastic unit 142 is compressed attending with the downward movement of the pushing element 141 and the compression force compels the lower end of the pushing element 141 moves along the displacement-restricting guiding trench 1311*a* downward to the right and reaches the tilted surface of the switching body 131*a* to sway the switching assembly 13*a*. At this time, the switching assembly 13*a* is tilted along a direction from the upper right to the lower left (the displacement-restricting guiding trench 1311*a* turned to the right and the pushing unit 1321*a* turned to the left). Meanwhile, the pushing unit 1321*a* pushes against the extending structure 122*a* to force the contact plates 12*a* tilted to the left to switchably contact the plurality of second conductive terminals 1111*a* so as to generate the conductive circuit loops between the plurality of first conductive terminals 1111 and the plurality of second conductive terminals 1111*a*. At this time, the circuit loops between the plurality of first conductive terminals 1111 and the plurality of third conductive terminals 1111*b* are opened. The conductive circuit loops between the plurality of first conductive terminals 1111 and the plurality of second conductive terminals 1111*a* will be maintained if the user continuously presses the button (not to release the button).

However, when the user releases the pressing unit 143, the pressing unit 143 returns to its original position. Meanwhile, with the recovery force of the first elastic unit 142, the pushing element 141 moves upward to its original position along the displacement-restricting guiding trench 1311*a* and the pushing unit 1321*a* moves toward the right to slide downward along the extending structure 122*a*. At this time, the switching assembly 13*a* also returns to its original position, the extending structure 122*a* forces the contact plate 12*a* to return to its original horizontal position to turn off the circuit loop, and the pushing element 141 returns to the original high point of the displacement-restricting guiding trench 1311*a*. In practice, the contact plate 12*a* may show a tilted position with a higher right end or a higher left end to turn off the circuit loop.

According to the above mentioned operation theory of the push button switch with the contact plate having an extending structure, the circuit loop is conducted once the user presses the push button switch 1 but would be turned off when the push button switch 1 is released. Thus, people skilled in the art will understand that the push button switch needs a continuously pressing action to maintain the temporarily switching of the circuit loop and the circuit loop will return to its original setting once the push button switch is released.

Based on the technical features and the operation theory of the above mentioned embodiment, it should be understood by people skilled in the art that the present invention is superior to the prior art in the aspects of:

First, when the push button switch of the present invention is switched, the pressing force from the top can be distributed through the two diagonal surfaces of the displacement-restricting guiding trench. In addition, because the length of the first conductive terminal, the second conductive terminal, and the third conductive terminals are different, a structure with a higher middle portion would be created to distribute the force applied to the planar contact plate or the contact plate with the extending structure. The above mentioned features are helpful for distributing the pressure from the top to extend the lifetime of the push button switch.

Secondly, the designs of the push button switch with a contact plate of a planar structure and the push button switch with a contact plate having an extending structure are provided in the present invention. The two designs have different operation method. For the push button switch with the contact plate of a planar structure, after the push button switch is pressed, the circuit loop cannot return to its original setting automatically after the pressing action is stopped. Another pressing action is needed to have the circuit loop returns to its original setting. For the push button switching with the contact plate having the extending structure, a continuous pressing action is needed to maintain the conduction of the circuit loop, and the circuit loop would return to its original setting (the off state) once the pressing action is stopped.

Thirdly, attending with the number of conductive terminals being used in the present invention the number of circuit loops of the switching assembly in accordance with push button switching of the present invention can be changed such that the push button switch of the present invention can be applied not only to the switch with single circuit loop but also to the switch with plural circuit loops to extend the applications of the push button switch.

The detail description of the aforementioned preferred embodiments is for clarifying the feature and the spirit of the present invention. The present invention should not be limited by any of the exemplary embodiments described herein, but should be defined only in accordance with the following claims and their equivalents. Specifically, those skilled in the art should appreciate that they can readily use the disclosed conception and specific embodiments as a basis for designing or modifying other structures for carrying out the same purposes of the present invention without departing from the scope of the invention as defined by the appended claims.

What is claimed is:

1. A push button switch, comprising:

a base, having at least a first cavity with a plurality of first conductive terminals, a plurality of second conductive terminals, and a plurality of third conductive terminals assembled therein, and a length of the first conductive terminal being greater than that of the second conductive terminal and that of the third conductive terminal;

a plurality of contact plates, which is of a planar structure, connected to the plurality of first conductive terminals;

a switching assembly, movably connected to the base, and the switching assembly comprising:

a switching body, comprising:

a displacement-restricting guiding trench, located on a surface of the switching assembly;

a plurality of second cavities, located on another side of the switching assembly; and a plurality of switching units, respectively arranged in the second cavities and pushing against the contact plates; and a push button assembly, connected to the base, and the push button assembly comprising:

a pushing element, pushing against the displacement-restricting guiding trench; and a first elastic unit, assembled to the pushing element;

wherein, when the push button assembly is pressed, the pushing element moves in the displacement-restricting guiding trench to sway the switching assembly and the switching unit synchronously, so as to have the contact plates switchably conducted at one of the plurality of second conductive terminals and the plurality of third conductive terminals.

2. The push button switch of claim 1, wherein, each of the plurality of contact plates has at least two connecting grooves for connecting the plurality of first conductive terminals.

3. The push button switch of claim 1, wherein each of the plurality of switching units includes a pushing unit and a second elastic unit, the pushing unit pushes against one of the plurality of contact plates and has a groove, and the second elastic unit is assembled in the groove and partially located in the second cavity.

4. The push button switch of claim 3, wherein the first elastic unit and the second elastic unit are selected from a group consisting of a spring and a rubber.

5. The push button switch of claim 1, wherein the push button assembly further comprises a pressing unit, connected to the base, for a user to press and control the contact plates switchably conducted at one of the plurality of second conductive terminals and the plurality of third conductive terminals.

6. A push button switch, comprising:

a base, having at least a first cavity with a plurality of first conductive terminals, a plurality of second conductive terminals, and a plurality of third conductive terminals assembled therein, and a length of the first conductive terminal being greater than that of the second conductive terminal and that of the third conductive terminal;

a plurality of contact plates, connected to the plurality of first conductive terminals, and having at least an extending structure extended and protruded therefrom;

a switching assembly, movably connected to the base, and the switching assembly comprising:

a switching body, comprising:

a displacement-restricting guiding trench, located on a surface of the switching assembly;

a plurality of second cavities, located on another side of the switching assembly; and a plurality of switching units, respectively arranged in the second cavities and pushing against the contact plates; and a push button assembly, connected to the base, and comprising:

a pushing element, pushing against the displacement-restricting guiding trench; and a first elastic unit, assembled to the pushing element;

wherein, when the push button assembly is pressed, the pushing element moves in the displacement-restricting guiding trench to sway the switching assembly and the switching unit synchronously such that the extending structure is pressed to tilt the contact plate so as to have the contact plates switchably conducted at one of the plurality of second conductive terminals and the plurality of third conductive terminals.

7. The push button switch of claim 6, wherein, each of the plurality of contact plates has at least two connecting grooves for connecting the plurality of first conductive terminals.

8. The push button switch of claim 6, wherein the extending structure is composed of metal.

9. The push button switch of claim 6, wherein each of the plurality of switching unit includes a pushing unit and a second elastic unit, the pushing unit pushes against one of the plurality of contact plates and has a groove, and the second elastic unit is assembled in the groove and partially located in the second cavity.

10. The push button switch of claim 9, wherein the first elastic unit and the second elastic unit are selected from a group consisting of a spring and a rubber.

11. The push button switch of claim 6, wherein the push button assembly further comprises a pressing unit, connected to the base, for a user to press and control the contact plates switchably conducted at one of the plurality of second conductive terminals and the plurality of third conductive terminals.

* * * * *